US010870507B2

(12) United States Patent
Fioravanti

(10) Patent No.: US 10,870,507 B2
(45) Date of Patent: Dec. 22, 2020

(54) DEVICE FOR CONTINUOUS COMPENSATION OF STRETCHING OF FILM DURING DRAWING APPLICABLE ON PACKAGING MACHINES

(71) Applicant: PFM IBERICA PACKAGING MACHINERY S.A., Barcelona (ES)

(72) Inventor: Andrea Fioravanti, Barcelona (ES)

(73) Assignee: PFM IBERICA PACKAGING MACHINERY S.A., Barcelona (ES)

( * ) Notice: Subject to any disclaimer, the term of this patent is extended or adjusted under 35 U.S.C. 154(b) by 351 days.

(21) Appl. No.: 15/555,461

(22) PCT Filed: Feb. 16, 2016

(86) PCT No.: PCT/EP2016/053251

§ 371 (c)(1),
(2) Date: Sep. 1, 2017

(87) PCT Pub. No.: WO2016/139056

PCT Pub. Date: Sep. 9, 2016

(65) Prior Publication Data

US 2018/0037346 A1 Feb. 8, 2018

(30) Foreign Application Priority Data

Mar. 3, 2015 (IT) ..... VR2015A0037

(51) Int. Cl.
*B65B 9/073* (2012.01)
*B65B 41/16* (2006.01)
(Continued)

(52) U.S. Cl.
CPC ..... *B65B 9/073* (2013.01); *B65B 9/093* (2013.01); *B65B 9/2014* (2013.01);
(Continued)

(58) Field of Classification Search
USPC ..... 493/22, 29, 196
See application file for complete search history.

(56) References Cited

U.S. PATENT DOCUMENTS 5,000,725 A * 3/1991 Bauknecht ..... B26D 5/00 226/32
5,127,324 A * 7/1992 Palmatier ..... B41F 13/14 101/181

(Continued)

FOREIGN PATENT DOCUMENTS

EP 0395027 10/1990
EP 0999141 5/2000
WO WO-2016180441 A1 * 11/2016 ..... B41F 33/02

OTHER PUBLICATIONS

International Search Report for application No. PCT/EP2016/053251 dated Apr. 22, 2016.

*Primary Examiner* — Michelle Lopez
*Assistant Examiner* — Chinyere J Rushing-Tucker
(74) *Attorney, Agent, or Firm* — Workman Nydegger

(57) ABSTRACT

Described is a compensating device applicable on intermittent advancement packaging machines with wrapping material constituted by a film made of a flexible plastic material, for continuous compensating of a stretching of the film during drawing thereof, the machine comprising a first drawing group of the film, a mobile element able to exert a determined force on the film during advancement, the mobile element being conventionally known as a dancer and a second drawing group of the film arranged downstream of the first drawing group, where each drawing group is provided with a sensor for detecting markers located at regular intervals along the film, the compensating device being constituted by a third drawing group, located between the first and second drawing groups, the third drawing group being provided with a marker sensor, the third drawing group being provided with independent motorisation and an automatic roller opening system.

8 Claims, 5 Drawing Sheets

(51) Int. Cl.

| | |
|---|---|
| ***B65B 41/18*** | (2006.01) |
| ***B65H 23/188*** | (2006.01) |
| ***B65B 9/093*** | (2012.01) |
| ***B65B 9/20*** | (2012.01) |

(52) U.S. Cl.
CPC ..... *B65B 9/2028* (2013.01); *B65B 9/2035* (2013.01); *B65B 41/16* (2013.01); *B65B 41/18* (2013.01); *B65H 23/1882* (2013.01); *B65H 2301/4491* (2013.01)

(56) References Cited

U.S. PATENT DOCUMENTS 5,800,325 A * 9/1998 Wilkes ..... B31B 70/00 493/196
6,003,582 A * 12/1999 Blohowiak ..... B31B 50/00 156/567
6,024,983 A * 2/2000 Tice ..... A61K 9/1647 424/501
6,247,293 B1 * 6/2001 Todd ..... B29C 65/18 53/329.2
6,725,625 B1 * 4/2004 Honma ..... B29C 65/02 53/64
7,802,504 B1 * 9/2010 Wilkes ..... B26D 1/065 83/257
2004/0173073 A1 * 9/2004 Wilkes ..... B26D 5/32 83/371
2005/0061189 A1 * 3/2005 Brandenburg ..... B41F 13/025 101/485
2005/0247220 A1 * 11/2005 Brandenburg ..... B26D 5/20 101/226
2007/0144373 A1 * 6/2007 Okura ..... B41F 33/0081 101/226
2009/0277140 A1 * 11/2009 Tsuruta ..... B65B 9/20 53/551
2011/0277645 A1 * 11/2011 Smith ..... B65H 23/1882 101/23

* cited by examiner

DEVICE FOR CONTINUOUS COMPENSATION OF STRETCHING OF FILM DURING DRAWING APPLICABLE ON PACKAGING MACHINES

CROSS-REFERENCE TO RELATED APPLICATIONS

The present invention is a 35 U.S.C. § 371 U.S. National Stage Application corresponding to PCT Application No. PCT/EP2016/053251, filed on Feb. 16, 2016, which claims priority to Italian Patent Application No. VR2015A000037, filed Mar. 3, 2015. The entire content of each of the aforementioned patent applications is incorporated herein by reference.

TECHNICAL FIELD

This invention relates to a compensating device applicable on intermittent advancement packaging machines with wrapping material constituted by a flexible film, designed for continuously compensating the stretching of the film during drawing.

The aim of the compensating device according to this invention is to overcome some problems encountered with the traditional solutions on the market, according to which in order to correct stretching problems it was necessary to stop the machine and move the operating stations to an extent equal to the stretching of the film.

As indicated in more detail below, the device according to this invention inserts an additional drawing group between the two groups already necessarily present, with the marker sensor, with the advantage of compensating any stretching of the film during the wrapping steps.

The invention applies in the mechanical field applied to packaging, and in particular to automatic packaging machines in food product lines.

BACKGROUND ART

Use is known in the packaging sector of packaging machines which are part of a system which is able to automatically place a product in a bag and in a carton, for example a product of the food type but also other types, by means of automatic packaging lines.

The food products or other products to be packaged are automatically sent towards the packaging lines which use horizontal or vertical packaging machines, such as the flow pack type, which make closed packages, generally with three seals, starting from a reel of hot or cold sealing wrapping material.

The packaging machines may be of types which are also very different to each other, but they all have in common the aim of placing the product in a bag, starting from a reel of heat-sealing wrapping material, and conveying it towards the boxing sector.

It is also known that a flexible film of plastic material is used during the packaging process, which passes along different sections, also along vertical or horizontal directions in such a way as to allow the product to be wrapped in subsequent processing steps, and that in some stretches the film, by the effect of some processing operations, as in the case of sealing, is subjected to a constant tension and undergoes a stretching.

More specifically, the traditional packaging system uses a first drawing group, an element conventionally known as "dancer", and a second drawing group, where each group is equipped with marker sensor, that is to say, a sensor which is able to detect on the film the presence of a mark made on the film.

With this system, the tension of the film and its compensation is obtained by the weight of the dancer and during the drawing step the two groups work in a synchronised fashion in such a way as to keep an angle of the dancer as constant as possible, which corresponds to a constant tension of the film.

The problem of the tensioning anomalies in traditional machines occur mainly in the horizontal stretches in which the film, due to the effect of the various processing operations, such as the sealing operations, is subjected to a constant tension and undergoes a stretching.

This means that the processing operations on the film are no longer stepwise correct, that is to say, they do not respect the correspondence of the mark on the film, and in these cases it is normally necessary to stop the machine and move the stations to a position equal to the stretching of the film.

Normally, traditional machines operating with different wrapping material encounter different stretching in terms of extent, and that means that it is necessary to make an adjustment at each reel change.

All this results in problems linked to the need for machine stoppages and the necessary successive adjustments which must be performed mainly in manual mode.

DESCRIPTION OF THE INVENTION

The aim of this invention is to provide a compensating device applicable on intermittent advancement packaging machines with wrapping material constituted by a flexible film of plastic material, designed for continuously compensating the stretching of the film during drawing, creating a condition which is able to eliminate or at least reduce the above-mentioned drawbacks.

The aim of the invention is also to provide a device for compensating the tension of the film applicable on intermittent advancement packaging machines with wrapping material constituted by a flexible film of plastic material which is able to automatically adjust all the stations in very quick succession, making this operation extremely simple, fast and precise.

This is achieved by means of a compensating device applicable to packaging machines with intermittent advancement, the features of which are described in the main claim.

The dependent claims of the solution according to this invention describe advantageous embodiments of the invention.

The main advantage of this solution relates to the fact that the device inserts an additional drawing group between the two already necessarily present with the marker sensor, thus achieving a control on the tensioning of the film and a optimum performance of the machine which can work continuously and without interruptions for adjustment due to problems with the film.

In fact, the additional drawing group according to the invention, unlike the other two, is provided with a controlled roller opening mechanism which, during the drawing step, works in a synchronised way with the other drawing groups and contemporaneously compares a signal of a marker sensor thereof with a marker sensor of a successive drawing group.

DESCRIPTION OF THE DRAWINGS

Other features and advantages of the invention will become clear on reading the description given below of one embodiment, provided as a non-limiting example, with the help of the accompanying drawings, in which.

DESCRIPTION OF AN EMBODIMENT OF THE INVENTION

Figure 1:
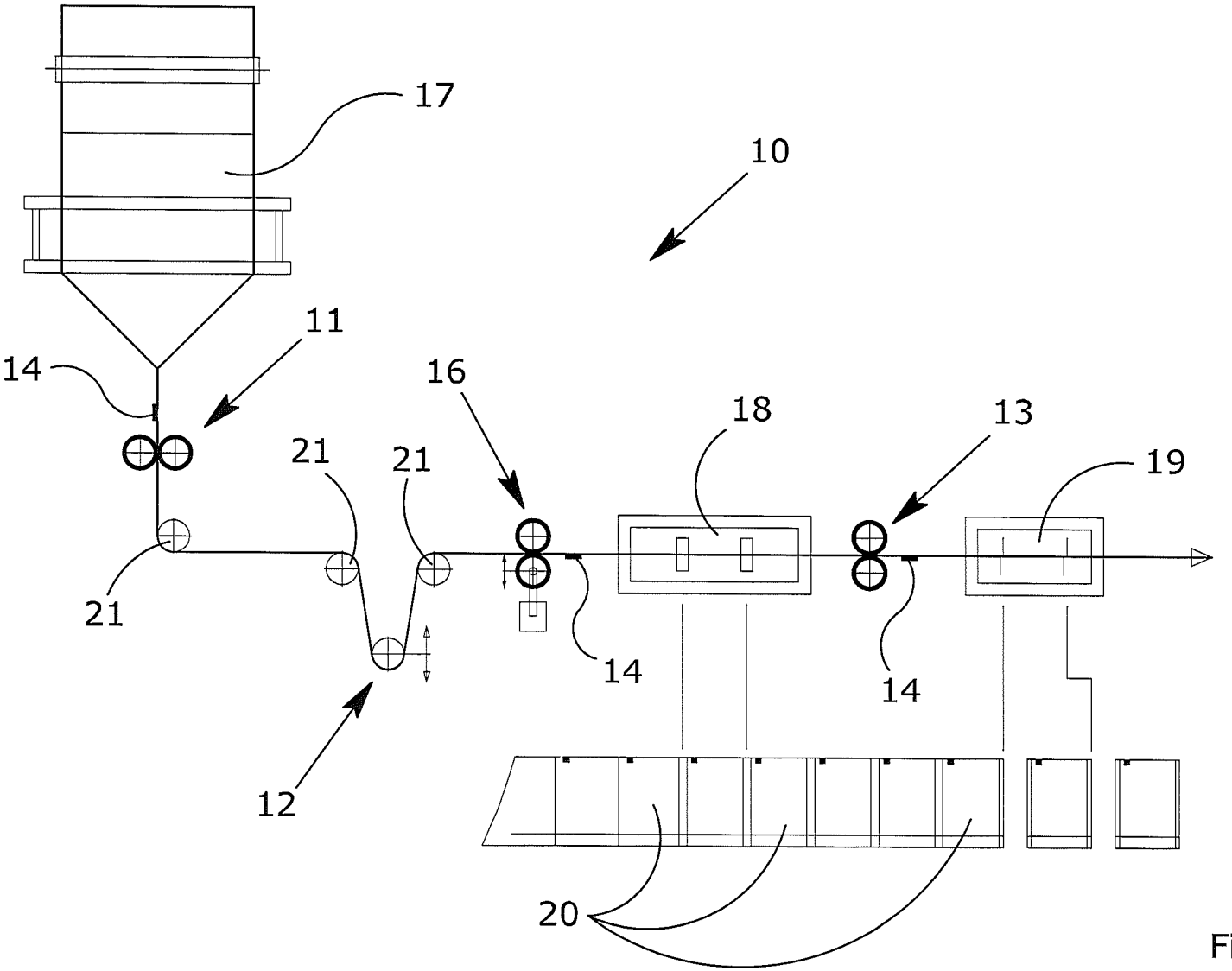
FIG. 1 is the schematic view of an intermittent advancement packaging machine of the type with wrapping material consisting of a flexible film of plastic material which is equipped with a compensating device according to the invention.
Figure 2:
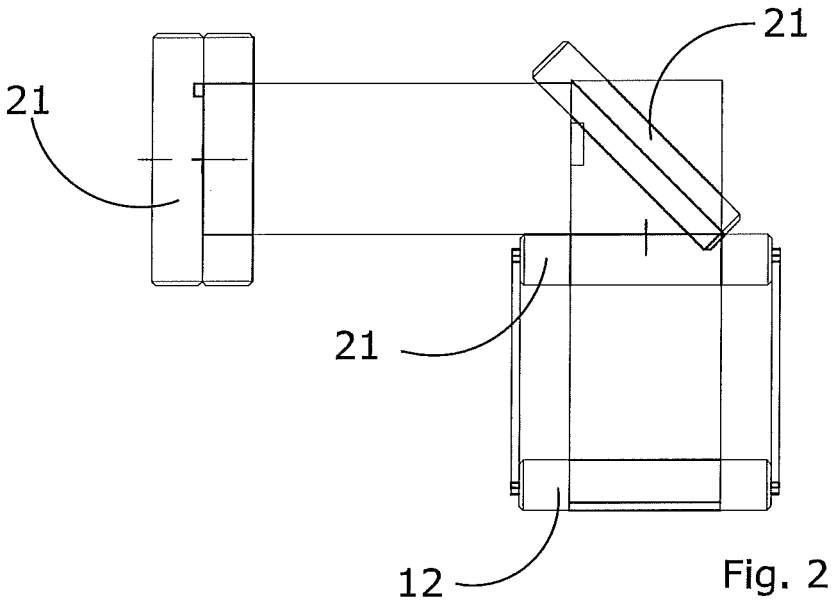
FIG. 2 is a schematic side view of the packaging machine of FIG. 1 equipped with a compensating device.
Figure 3:
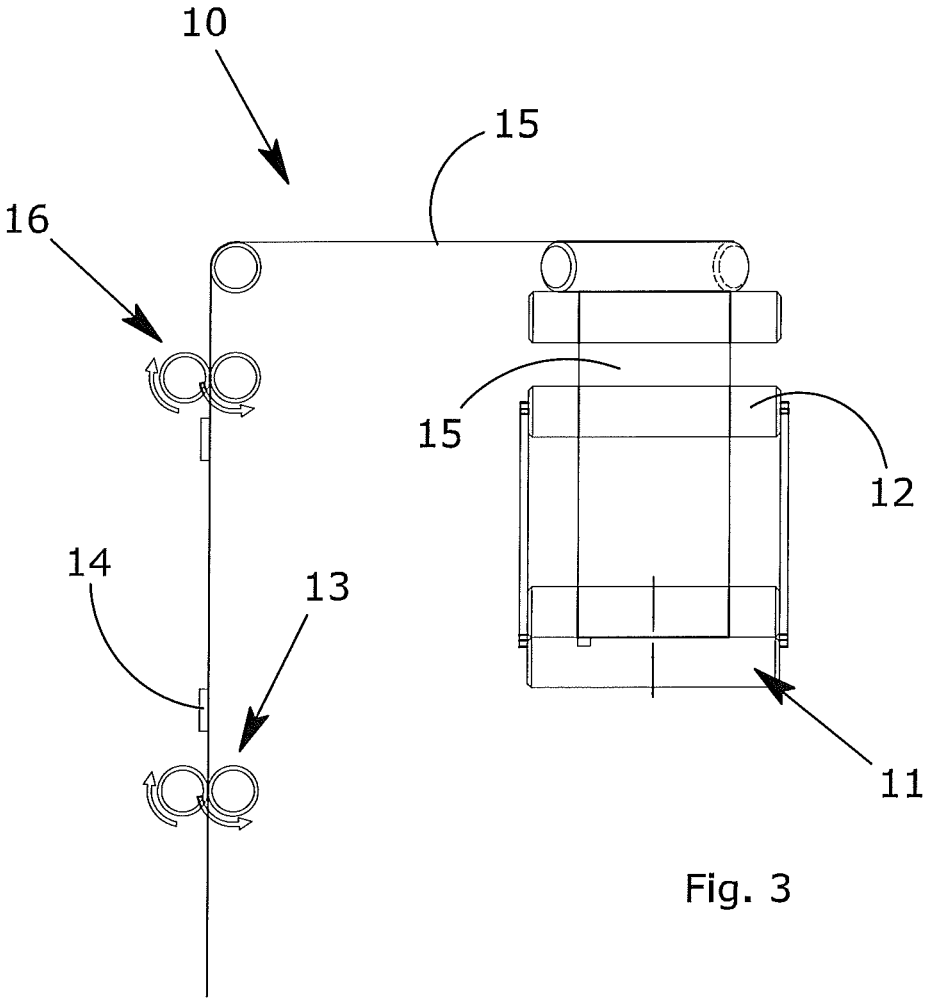
FIG. 3 is a schematic plan view of the packaging machine of the preceding drawings.
Figure 4:
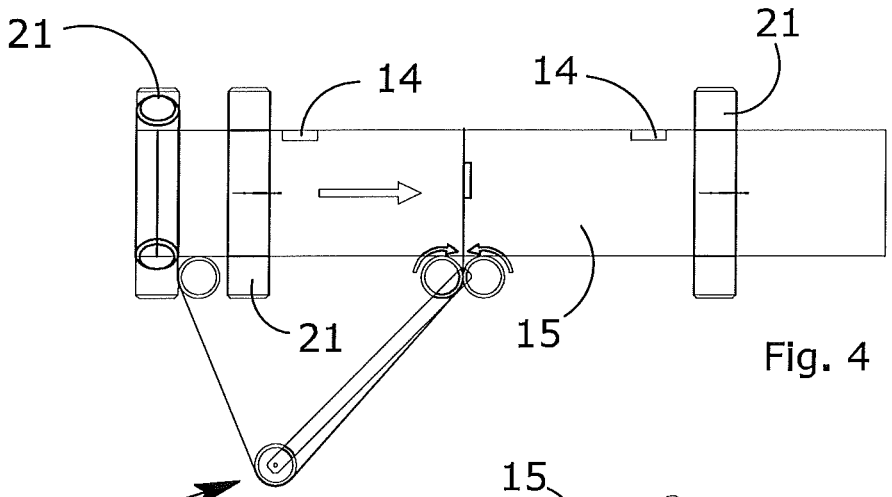
FIG. 4 shows a front layout of a packaging machine equipped with the compensating device.
Figure 5:
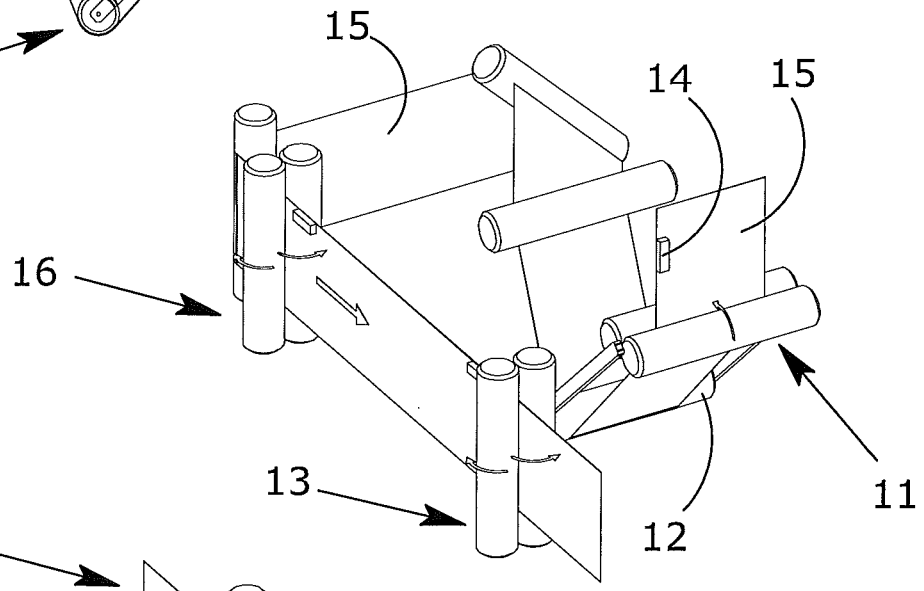
FIGS. 5 and 6 show schematic views highlighting the layout of the packaging machine equipped with a compensating device shown from two different angles.
Figure 6:
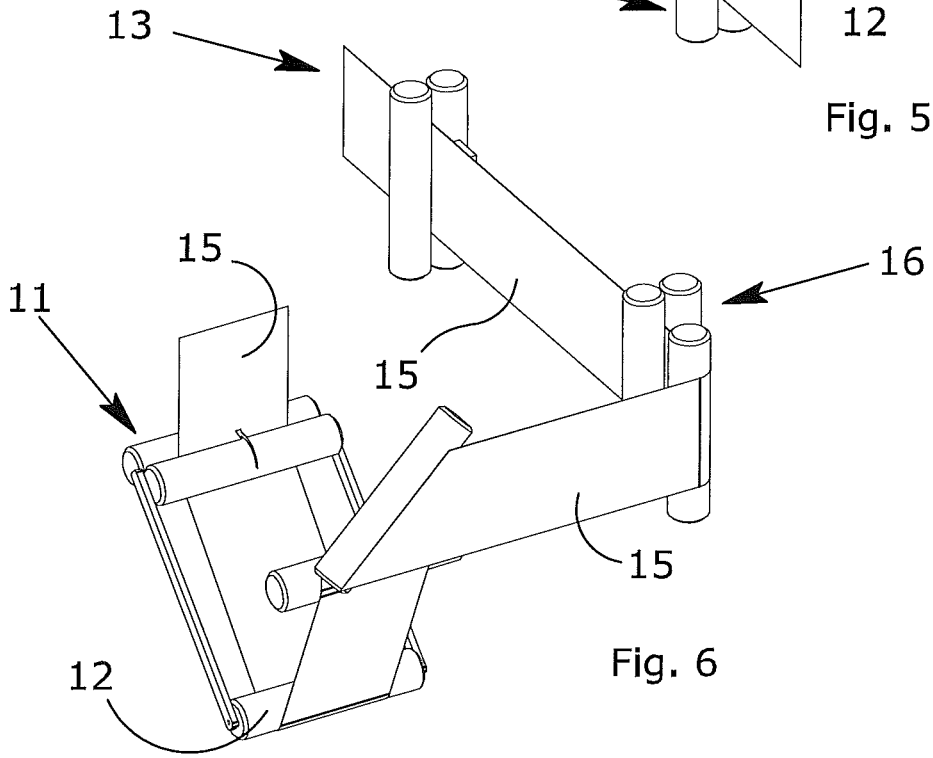
Figure 7:
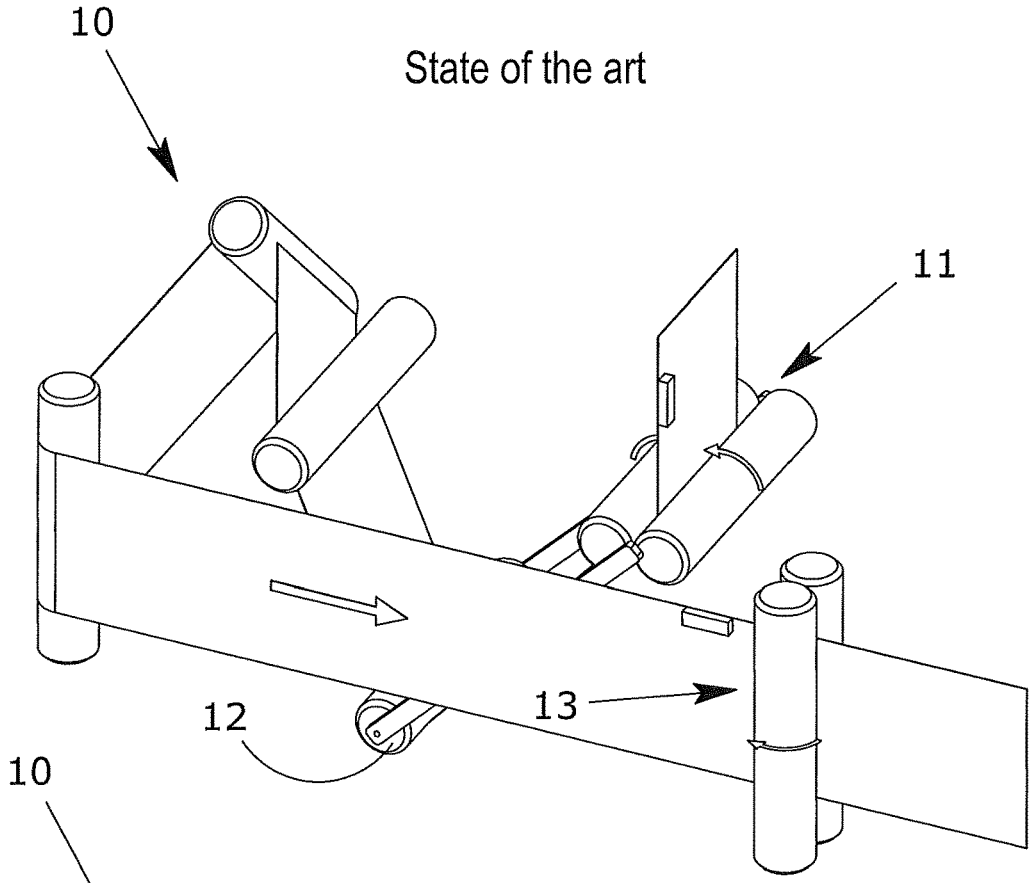
FIGS. 7 and 8 illustrate the schematic comparison respectively of a traditional machine and a machine according to the invention equipped with the compensating device.
Figure 8:
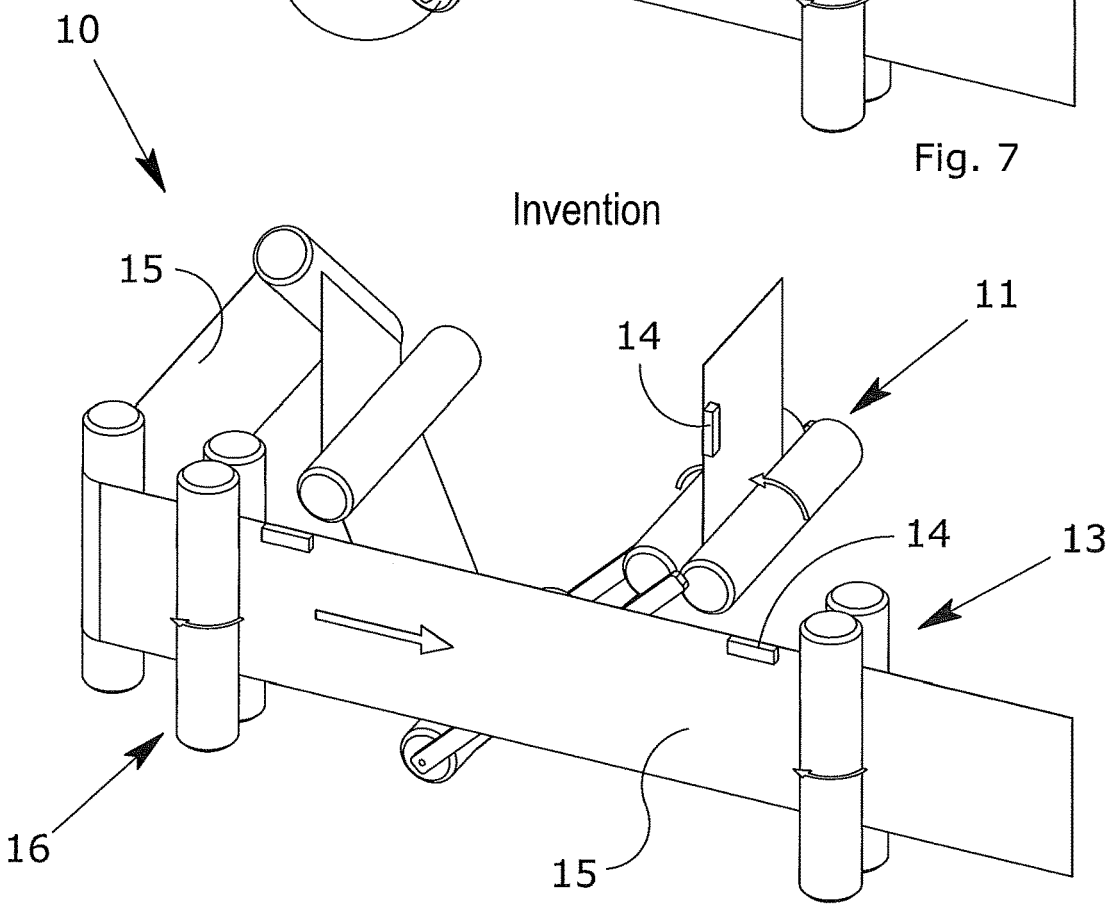
Figure 9:
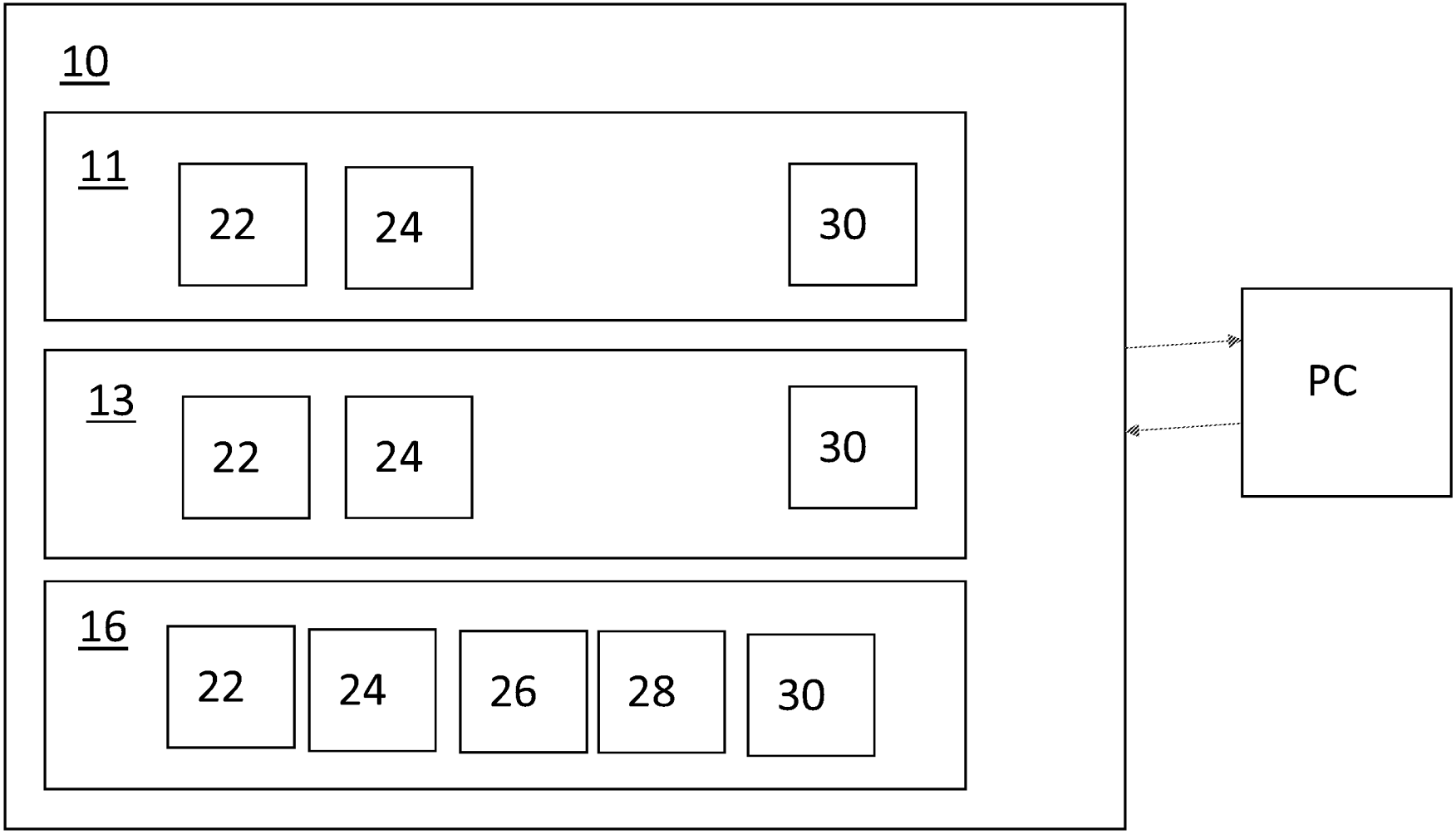
FIG. 9 schematically illustrates the intermittent advancement packaging machine and associated personal computer according to the invention.

With reference to the accompanying drawings, the numeral 10 denotes in its entirety the plant schematically illustrated of a 'flow pack' type packaging machine, that is to say, an automatic machine for horizontal packaging which uses a single reel of film for forming the packaging by means of three seals, two transversal and one longitudinal, which can be used mainly, although not exclusively, in the food sector.

The machine 10 comprises a first drawing group 11, a mobile element able to exert a determined force on the film during advancement, conventionally known as a dancer 12 and a second drawing group 13, where each drawing group is provided with a relative or marker sensor 22 for detecting markers 14 located at regular intervals along a film 15.

The tension of the film and its compensation is normally given by the weight of the dancer 12 and during the drawing step the two groups work in a synchronised fashion in such a way as to keep an angle of the dancer as constant as possible, which corresponds to a constant tension.

To compensate for the stretching which occurs in the horizontal section, in which the film, due to the effect of the various processing operations, such as the sealing operations, under constant tension conditions, undergoes a stretching, according to the invention there is an additional drawing group 16 between the two already necessarily present, the unit 16 being also equipped with the marker sensor 22.

In FIG. 1 the numeral 17 denotes a unit for feeding, conveying and folding the film 15, numeral 18 denotes a vertical sealing station, numeral 19 denotes a cutting station, numeral 20 denotes a row of bags being advanced, and numeral 21 denotes a pair of driving rollers for driving the film.

The additional drawing group 16, unlike the other two drawing groups 11 and 13, is provided with a controlled roller opening system or mechanism 26 which, during the drawing step, works in a synchronised way with the other drawing groups and contemporaneously compares a signal of a marker sensor 22 thereof with a marker sensor 22 of a successive drawing group, such as drawing group 13.

The additional drawing group 16 is controlled and managed by a personal computer (PC) which also manages the other two drawing groups 11 and 13.

The PC is able to calculate times and distances between the markers 14, as it receives the signal from the marker sensors 22, compares them and consequently commands the motors 28 of the third additional drawing group 16 to accelerate or decelerate the rollers 30 of the third additional drawing group 16, or near or distance the rollers 30 of the third additional drawing group 16 from one another.

If differences are detected, i.e. if an overstretching of the film has been verified, the additional drawing group 16 accelerates or decelerates by an amount equal to the difference, thus compensating for the stretching.

This is performed in a continuous and automatic fashion without the need to stop the machine.

Also, during the stop step the two drive rollers 30 open automatically allowing any tension accumulated in the film between the two pulls to be annulled.

The invention as described above refers to a preferred embodiment. It is nevertheless clear that the invention is susceptible to numerous variations falling within the scope of the disclosure, in the context of technical equivalents.

The invention claimed is:

1. A compensating device applicable on intermittent advancement packaging machines with wrapping material constituted by a film made of a flexible plastic material, for continuous compensating of a stretching of the film during drawing thereof, the machine comprising:

a sealing station;

a cutting station;

a first drawing group of the film, a mobile element able to exert a determined force on the film during advancement, the mobile element comprising a dancer;

a second drawing group of the film arranged downstream of the first drawing group and disposed between the sealing station and the cutting station, wherein each of the first and second drawing groups is provided with a marker sensor for detecting markers located at regular intervals along the film; and a third drawing group, located between the first and second drawing groups and upstream of the sealing station and downstream of the mobile element, the third drawing group being provided with a marker sensor, the third drawing group being provided with independent motorization and an automatic roller opening mechanism, wherein the roller opening mechanism works in a synchronized way with the first drawing group and the second drawing group and contemporaneously compares a signal of a marker sensor of the third drawing group with a marker sensor of the second drawing group during drawing the film.

2. The device according to claim 1, wherein:

in a case in which an overstretching of the film has been verified, the motorisation of the third drawing group accelerates or decelerates by an amount equal to the difference, thus compensating for the stretching.

3. The device according to claim 1, wherein the third drawing group is controlled and managed by a personal computer (PC) which also manages the first drawing group and the second drawing group.

4. The device according to claim 3, wherein the PC is able to:

calculate times and distances between the markers, as it receives the signal from the marker sensors;

compare the received signals, and consequently direct the motors of the third drawing group to accelerate or decelerate rollers of the third drawing group, or near or distance the rollers from one another.

5. A film stretching compensation device for a packaging machine with intermittent advancement movement, a wrapping material being constituted by a film made of a flexible plastic material, for carrying out a continuous compensation of film stretching during drawing thereof, the machine comprising:

a sealing station;

a cutting station;

a first film drawing unit including motorized first driving rollers;

a further mobile roller element exerting a given force on the film during advancement thereof;

a second film drawing unit including motorized second driving rollers arranged downstream of the first film drawing unit group and disposed between the sealing station and the cutting station, where each film drawing unit comprises a second marker sensor for detecting markers located at regular intervals along the film;

wherein said film stretching compensation device comprises a third film drawing unit and upstream of the sealing station and downstream of the mobile element, located between the first and second film drawing units, the third film drawing unit comprising a third marker sensor, as well as a motor and a roller opening mechanism for automatically controlling a displacement of driving rollers of the third film drawing unit, wherein the roller opening mechanism works in a synchronized way with the first drawing group and the second drawing group and contemporaneously compares a signal of the third marker sensor of the third drawing group with the second marker sensor of the second drawing group during drawing the film.

6. The device of claim 5, wherein the third drawing unit comprises a controlled roller opening mechanism which, during a film drawing operation, works in a synchronised way with the first and second drawing units and simultaneously compares a signal of the marker sensor thereof with the marker sensor of a subsequent drawing unit.

7. The device of claim 5, wherein the third drawing unit is controlled and managed by a personal computer (PC) which also manages the first drawing unit and the second drawing unit.

8. The device of claim 7, wherein the PC is configured to:

calculate times and distances between the markers, as it receives the signal from the marker sensors;

compare the received signals; and consequently direct motors of the third drawing unit to either accelerate or decelerate the rollers, or move the rollers close or away from each other.

* * * * *